US008777227B2

(12) United States Patent
Kraft

(10) Patent No.: US 8,777,227 B2
(45) Date of Patent: Jul. 15, 2014

(54) APPARATUS AND METHODS FOR ORGANIZING AND PLAYING A GAME

(75) Inventor: Ryan Kraft, Fort Scott, KS (US)

(73) Assignee: Ward Kraft, Inc., Fort Scott, KS (US)

( * ) Notice: Subject to any disclaimer, the term of this patent is extended or adjusted under 35 U.S.C. 154(b) by 309 days.

(21) Appl. No.: 13/183,861

(22) Filed: Jul. 15, 2011

(65) Prior Publication Data

US 2012/0013075 A1 Jan. 19, 2012

Related U.S. Application Data

(60) Provisional application No. 61/365,182, filed on Jul. 16, 2010.

(51) Int. Cl.
*A63F 9/00* (2006.01)

(52) U.S. Cl.
USPC ..... 273/459; 273/440; 273/445

(58) Field of Classification Search
USPC ..... 273/440, 441, 444, 445, 459, 460, 461
See application file for complete search history.

(56) References Cited

U.S. PATENT DOCUMENTS

| | | | | |
|---|---|---|---|---|
| 5,924,695 | A * | 7/1999 | Heykoop | 273/459 |
| 6,273,425 | B1 * | 8/2001 | Westfall et al. | 273/459 |
| 6,320,495 | B1 * | 11/2001 | Sporgis | 340/323 R |
| 6,682,074 | B2 * | 1/2004 | Weston | 273/459 |
| 7,258,614 | B1 * | 8/2007 | Kates et al. | 463/42 |
| 7,946,910 | B2 * | 5/2011 | Feeney et al. | 463/9 |
| 8,353,749 | B2 * | 1/2013 | Sanders | 463/6 |
| 2012/0013075 | A1 * | 1/2012 | Kraft | 273/447 |

* cited by examiner

*Primary Examiner* — Raleigh W Chiu
(74) *Attorney, Agent, or Firm* — Lathrop & Gage LLP

(57) ABSTRACT

Systems and methods of organizing and conducting games are set forth herein. One method of organizing and conducting a game comprises steps of arranging a plurality of contestants within a predefined adventurous area, and providing a plurality of items, each item having a distinct identifying characteristic. An ultralight with a programmable ejection system launches the plurality of items into the adventurous area through the air according to a predetermined routine. The contestants are allowed to search for and collect the items launched by the ultralight within the adventurous area before the game ends. Means are provided for correlating the identifying characteristic of each item to a prize, and each contestant is allowed to retain the prize correlating to the identifying characteristic of the item that was collected by the contestant.

17 Claims, 7 Drawing Sheets

APPARATUS AND METHODS FOR ORGANIZING AND PLAYING A GAME

CROSS-REFERENCE TO RELATED APPLICATIONS

This application claims priority to U.S. Provisional patent application No. 61/365,182, filed on Jul. 16, 2010, which is incorporated herein by reference in its entirety.

FIELD OF THE INVENTION

The invention relates generally to the field of organizing and playing games.

SUMMARY

Systems and methods of organizing and conducting games are set forth herein. According to one embodiment, a method of organizing and conducting a game comprises the steps of arranging a plurality of contestants within a predefined adventurous area, and providing a plurality of items. Each item has a distinct identifying characteristic. An ultralight with a programmable ejection system launches the plurality of items into the adventurous area through the air according to a predetermined routine. The contestants are allowed to search for and collect the items launched by the ultralight within the adventurous area before the game ends. Means are provided for correlating the identifying characteristic of each item to a prize, and each contestant is allowed to retain the prize correlating to the identifying characteristic of the item that was collected by the contestant.

According to another embodiment, a method of conducting a game comprises the steps of arranging a plurality of contestants within a predefined adventurous area, and providing a plurality of items each having distinct machine readable indicia. A launching apparatus is provided for launching the plurality of items through the air into the adventurous area, and contestants are allowed to search for and retrieve the items launched into the adventurous area by the launching apparatus until the end of the game. A correlating unit is provided for correlating the machine readable indicia of each item to a corresponding prize. Each contestant is allowed to retain the prize correlating to the machine readable indicia of the item collected by the contestant.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
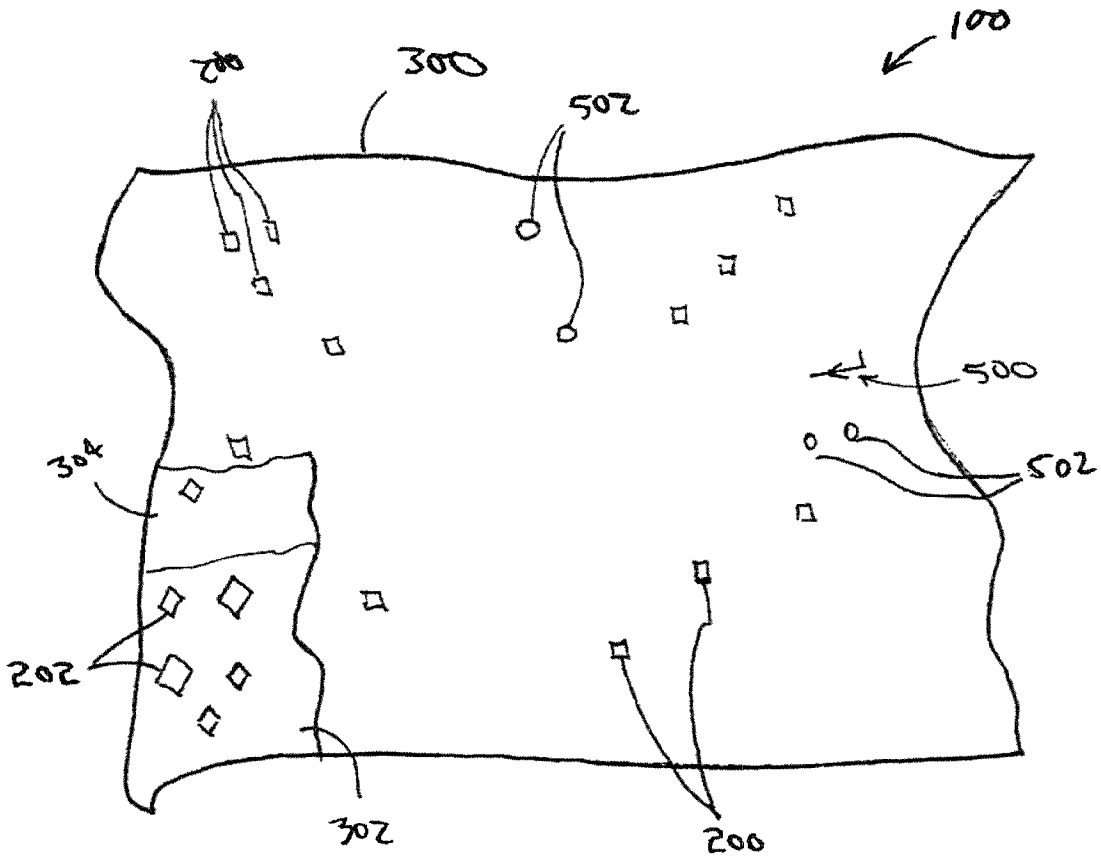
FIG. 1 is a plan view of an adventurous area according to an embodiment of the current invention.

Embodiments of the present invention provide systems and methods for organizing and playing a game. One embodiment of the game 100 is illustrated in FIGS. 1 through 7. As shown in FIG. 1, multiple participants 200 can play the game 100 at one time. The game 100 is played by participants 200 in an area called an adventurous area 300, and the adventurous area 300 is generally a large tract of land. For example, the adventurous area 300 may or may not be a tract of land that spans 1000acres and includes various terrain and/or wildlife hazards. Alternatively, although not a requirement, one or more city blocks with roads and pavements could serve as the adventurous area 300. Or, the adventurous area 300 may or may not be a hilly or mountainous area of land. Additionally, the adventurous area 300 may or may not contain streams or other bodies of water, and could possibly have trees, plants, vegetation, etc. In some embodiments, the adventurous area 300 may be enclosed to delineate the boundary of the adventurous area 300, however, enclosure of the adventurous area 300 is not necessitated. For example, the adventurous area 300 may be surrounded by a fence, rope or some other boundary marker. Natural boundaries (e.g., streams, lakes, mountains etc.) may also be used.

The adventurous area 300 may or may not have a defined starting area 302, as shown in FIG. 1. The starting area 302 may or may not be demarcated by signs and could potentially be of a different color than the rest of the adventurous area 300. The starting area 302 may or may not have a distinct entrance that leads into the adventurous area 300, such as a gate, ribbon or fence etc.

Figure 2:
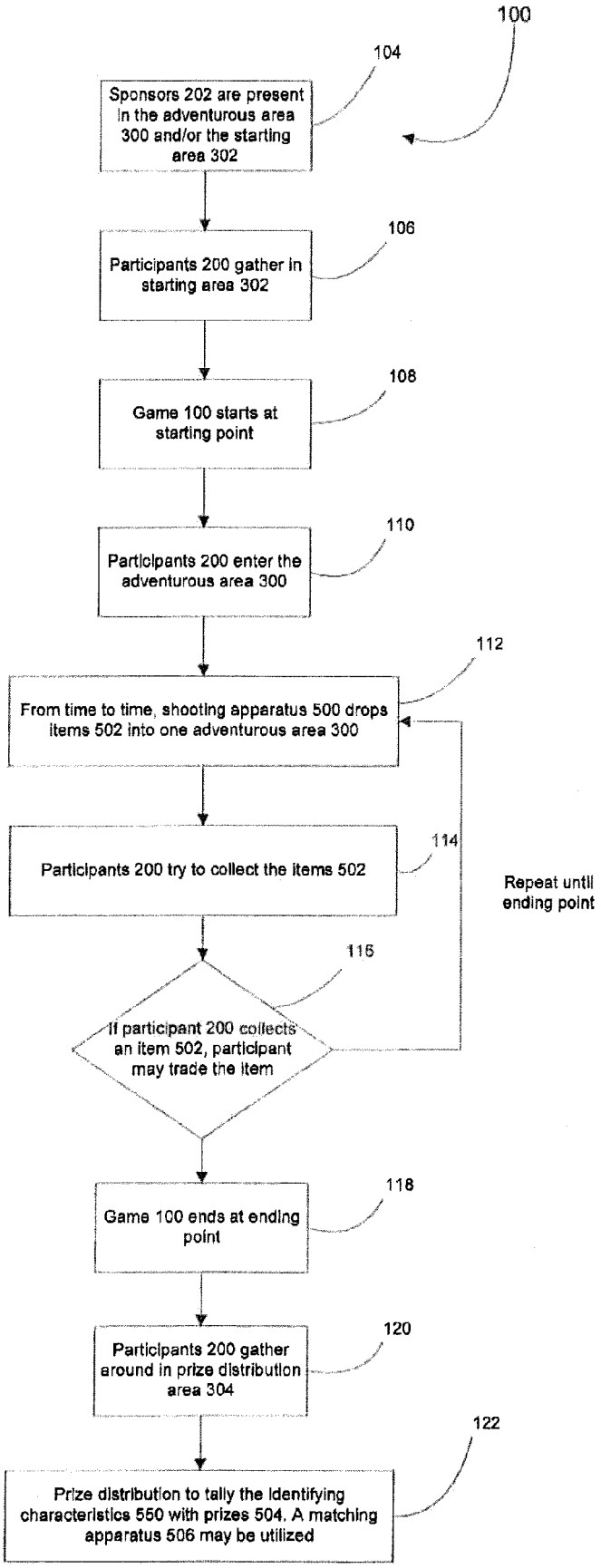
FIG. 2 outlines the steps of playing a game in accordance with an embodiment of the current invention.

Although not a requirement, at the outset, one or more sponsors 202 may be present at the starting area 302 and also within the adventurous area 300, as shown by FIG. 2 in step 104. The sponsors 202 may advertise products or product lines and may promote the same or different products or product lines. The sponsors 202 may or may not have prominently visible markings that identify the product or product lines that the sponsors 202 are sponsoring. For example, the sponsors 202 may wear apparel that denotes the name of the products or product lines being advertised.

In addition to advertising products or product lines, the sponsors 202 may or may not market and sell the respective products at the starting area 302 and/or within the adventurous area 300. The sponsors 202 may or may not have booths, stands, tables etc. on which the sponsors 202 place the products being marketed. These booths, stands, tables etc. may or may not be of different sizes and may or may not have signs or markings that represent the respective products or product lines of the sponsors 202. The sponsors 202 may also give out products for free, however, such giveaways are by no means required.

All the sponsors 202 may or may not be situated in the same general region at the starting area 302, or within or outside the adventurous area 300, or the sponsors 202 could possibly be dispersed. Especially if an extremely hazardous/rugged area 300 is used, the sponsors 202 may not be positioned in the area 300. Even where the extremely hazardous/rugged area 300 does not lend itself to positioning the sponsors 202 therein easily, however, the possibility of positioning the sponsors 202 in the area 300 is not foreclosed. By virtue of factors such as the placement of a sponsor 202 at a different area than another sponsor 202, or the size of the sponsor's booth as compared to the other booths, one sponsor 202 may or may not be more or less prominent than another sponsor 202.

The participants 200 gather in the starting area 302, as shown by step 106 in FIG. 2. The game 100 starts at a point in time referred to as the starting point, as shown by step 108. The participants 200 may be apprised of the starting point of the game 100 in a plurality of ways. For example, a loud sound may mark the starting point, such as the sound from the shooting of a cannon or a gun, or the blowing of a whistle. Or, a person may hold up a sign to specify the starting point. Alternatively, a light may turn on or change colors to indicate that the game 100 has started. Other ways to mark the starting point may also be employed.

The game 100 may start at any designated time and generally continues for several hours. For example, the game 100 may or may not start in the early morning and last until night fall. Or, the game 100 may or may not start at night and continue until day break. It is possible to alter the duration of the game such that the game 100 is played for longer than one day, or that the game 100 is played for less than an hour.

Once the game 100 starts, the participants 200 enter the adventurous area 300, as shown by step 110 in FIG. 2. All the participants 200 may be allowed to enter the adventurous area 300 at the same time, or the entry of the participants 200 into the adventurous area 300 may be staggered. The participants 200 may or may not be divided into teams, and only a certain number of participants 200 from each team may be allowed to enter the adventurous area 300 at the starting point. For example, the game 100 may have five hundred participants which are all allowed to enter the adventurous area 300 at the starting point. Or, the game 100 may have seven hundred participants, only half of which are allowed to enter the adventurous area 300 at the starting point. Participants 200 may be grouped by age or other characteristics, such that all participants 200 share common characteristics or such that prizes (discussed below) are disbursed with consideration of the different categories of participants 200. However, such a grouping of participants 200 based on the similarity of certain characteristics is not required. Liability waivers from the participants 200 may or may not be required before the participants 200 are allowed to participate in the game 100.

After entering the adventurous area 300, the participants 200 may or may not travel to different places within the adventurous area 300. If the participants 300 are divided into teams, team members may chose to travel together or the team members may disperse within the adventurous area 300.

Figure 3:
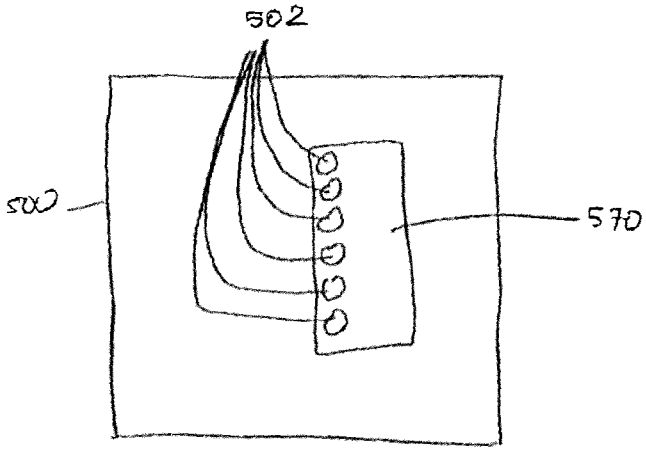
FIG. 3 is a plan view of a shooting apparatus according to an embodiment of the present invention.
Figure 4:
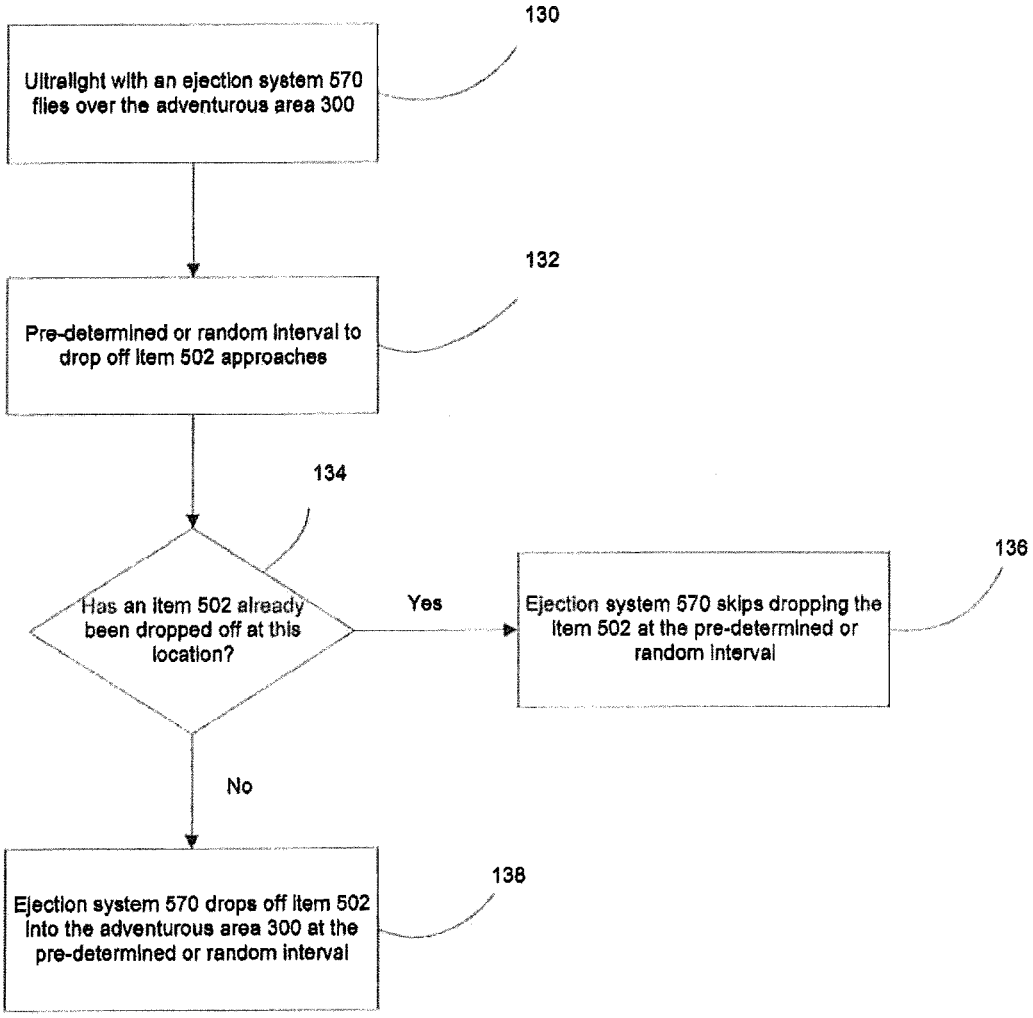
FIG. 4 outlines the steps taken by an ultralight having an ejection system as it flies over and drops items into the adventurous area of FIG. 1.

Every so often, one or more shooting apparatuses 500 are utilized to drop items 502 into the adventurous area 300 (as shown by step 112 in FIG. 2), unless all of the items 502 are distributed before the game 100 begins. The participants 200 may or may not be apprised of the shooting apparatuses 500 before the start of the game 100. As shown in FIG. 3, the shooting apparatus 500 may include an ejection system 570, however, such an ejection systems 570 is not required. The ejection system 570 may be used to facilitate dropping the items 502 into the adventurous area 300.

One shooting apparatus 500 may or may not be an airplane such as an ultralight with the ejection system 570. The ultralight with the ejection system 570 may possibly fly over all or part of the adventurous area 300, as shown by step 130 in FIG. 4, and drop one or more items 502 in the adventurous area 300, as shown by steps 132 through 138 in FIG. 4. The ejection system 570 may or may not be programmed to automatically drop the items 502 at pre-determined or random intervals during the ultralight's flight over all or part of the adventurous area 300. The ejection system 570 may or may not include a global positioning to keep track of the locations at which the items 502 are dropped off by the ejection system 570 during the game 100. Once the random or pre-determined time interval to drop off items 502 in the adventurous area 300 approaches, as shown by step 132 of FIG. 4, the ejection system 570 checks in query 134 whether an item 502 has already been dropped off at that particular location. If the answer to query 134 is no, i.e., an item 502 has not been dropped off at that location, then the ejection system 570 drops off one or more items 502 at that location in the adventurous area 300 at the random or pre-determined interval, as shown by step 138. Otherwise, if the answer to query 134 is yes, i.e., if one more items 502 have already been dropped off at that location in the adventurous area 300, then the ejection system 570 skips dropping the items 502 at the current random or pre-determined interval, as shown by step 136. Though benefits of the ejection system 570 may be lost, it may be possible for a person in the ultralight to drop the items 502.

Alternatively, the shooting apparatus 500 may or may not involve other flying apparatus, such as a person wearing a paramotor who rides over all or part of the adventurous area 300 and drops one or more items 502 into the adventurous area. Though the items 502 may be dropped by the person wearing the paramotor, the paramotor may have a chamber for storing the items 502 and an ejection system 570. For example, the chamber may have a door that is programmed to drop the items 502 at pre-determined or random intervals. Or, the shooting apparatus 500 could be a cannon that shoots the items 502 into the adventurous area 300. The cannon may be programmed to shoot the items 502 at different places within the adventurous area 300 at different times. The same or different apparatuses 500 could be used to drop off the items 502 into the adventurous area 300 for the duration of the game 100. The participants 200 generally do not know where the items 502 will land within the adventurous area 300.

The items 502 dropped off into the adventurous area 300 may be bags, flags, apparel or any other object. Same or different types of items 502 may be dropped off into the adventurous area 300. Participants 200 may or may not be made aware of the significance of the different types of items 502 before the starting point, or during the game 100, and the items 502 may or may not include advertisements. These items 502 may possibly be such that if they accidentally land on a participant 200, the participant 200 is not injured, and in some embodiments, the items 502 may be bio-degradable such that uncollected items substantially break down within about a week.

Figure 5:
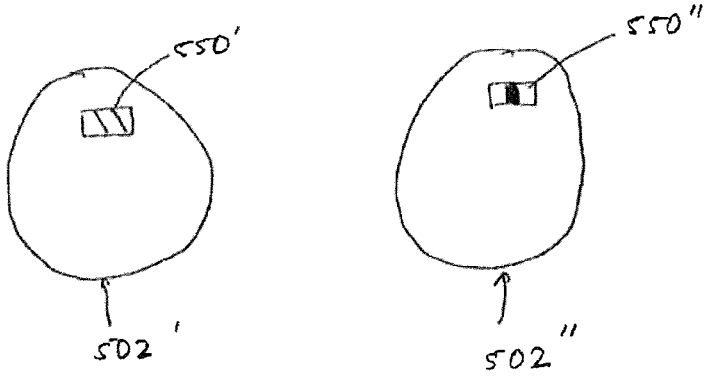
FIG. 5 is a plan view of two items having different identifying characteristics according to an embodiment of the current invention.
Figure 6:
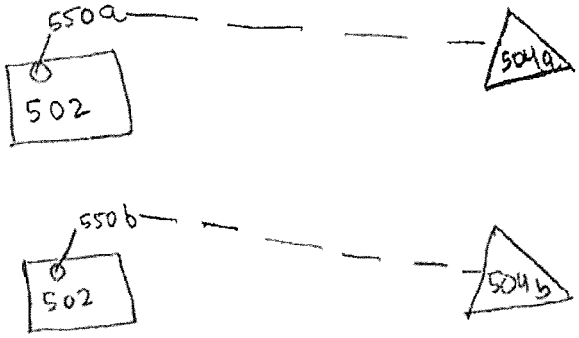
FIG. 6 shows two items having different identifying characteristics being matched to two different prizes.

Every item 502 that is dropped off into the adventurous area 300 may or may not include an identifying characteristic 550 that distinguishes that item 502 from the other items 502 that are also dropped off into the adventurous area 300. As shown in FIG. 5, for example, items 502' and item 502" have differing identifying characteristics 550' and 550" respectively. The identifying characteristic 550 may be a numeric, alphabetical, alpha-numeric, signals, or machine-readable code that is stamped, attached or otherwise noted on, or emitted from, the item 502. The machine-readable code may, for example, be a barcode. The identifying characteristic 550 of the item 502 may also be a color, or the shape or size of the item 502, or some other identifying characteristic(s) 550.

One of the objects of the game 100 is for the participants 200 to collect the items 502 that are dropped off within the adventurous area 300. The participants 200 travel around the adventurous area 300 in search of these items 502, as shown by step 114 in FIG. 2. The participants 200 may or may not be equipped with global positioning devices. If used, the global positioning devices may inform the participants 200 about the location of the items 502 that are dropped off in the adventurous area 300. The global positioning devices may also inform the participants 200 about the location of other participants 200, as well as the direction in which the other participants 200 are traveling. If global positioning devices are not allowed, participants 200 caught with global positioning devices may be penalized, such as by being expelled from the game 100. Officials dressed in distinctive or indistinctive attire and/or cameras may be spread throughout the area 300 to ensure others are playing fair, and measures such as tasers may be used to enforce rules. It is understood, however, that neither the officials, nor means of enforcement such as tasers are required by the game 100.

Some participants 200 may be able to find and collect one or more of the items 502, while other participants 200 may be unable to collect any of the items 502. If a participant 200 collects an item 502, the participant 200 may be allowed to trade that item 502, as shown by step 116. The participants 200 may trade the items 502 with the sponsors 202 in return for products that the sponsors 202 are advertising. Or, the participants 200 may trade the items 502 amongst themselves. For example, if the items 502 are bags, flags and shirts, and a particular participant 200 collects two bags and a flag, that participant 200 may trade one of the bags with another participant 200 for a shirt. In some embodiments, trading the items 502 may be strictly prohibited until after the ending point, or in its entirety.

The game 100 ends at a point in time referred to as the ending point, as shown by step 118. As indicated by FIG. 2, one or more of the steps 112, 114 and 116 may be repeated until the ending point passes. Much like the starting point, participants 200 may be apprised of the ending point in a number of ways. For example, a loud sound from a cannon, gun or whistle etc. may mark the ending point, or some other method to indicate the ending point may be employed. Or, the game 100 may have a predefined duration, and the game 100 may conclude at the end of this duration. After the ending point, the participants 200 may or may not be allowed to trade the items 502 with other participants 200 or the sponsors 202.

At the end of the game 100, the participants travel to and gather around in an area called the prize distribution area 304, as shown by step 120. As shown in FIG. 1, the prize distribution area 304 may be a different area than the starting area 302; however, it is possible that the prize distribution area 304 is the same as the starting area 302. Sponsors 202 may or may not be present within the prize distribution area 304. In some embodiments, the participants 200 bring along the items 502 that the participants 200 have collected throughout the game 100. In other embodiments, only items 502 that participants turn in before the ending point may be redeemed. The identifying characteristic 550 of each item 502 may or may not correspond to a prize 504; for example, in FIG. 6, prizes 504*a* and 504*b* correspond to identifying characteristics 550*a*, 550*b*, respectively. As shown by step 122 in FIG. 2, the identifying characteristic 550 of each item 502 is tallied and the participants 200 are given the prizes 504 that correspond to the identifying characteristics 550 of the items 502 (individually or collectively) that the participants 200 have collected.

Figure 7:
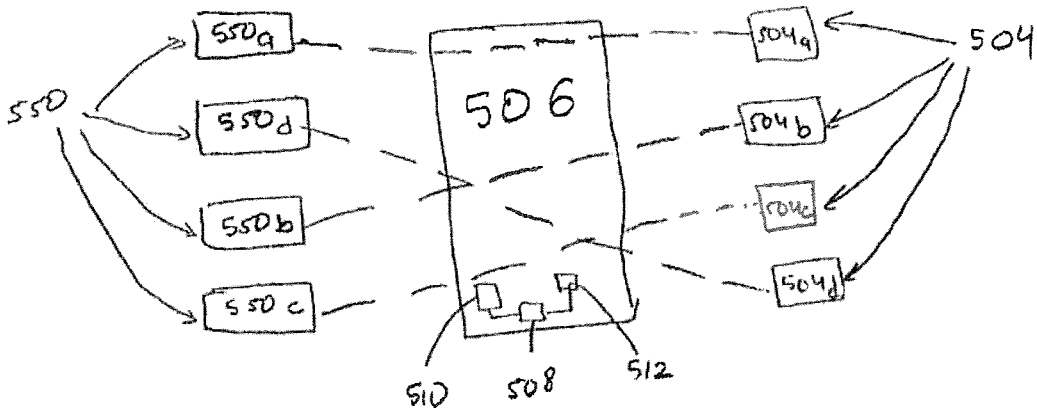
FIG. 7 is a plan view of a matching apparatus used to correlate the differing identifying characteristic of each item to a prize.

A matching apparatus 506 may or may not be used to match the identifying characteristic 550 of each item 502 with the corresponding prize 504. If used, the matching apparatus 506 may include a processor 508. An input device 510 and an output device 512 may be electrically connected to the processor 508. A matching apparatus 506 matching identifying characteristics 550*a*, 550*b*, 550*c*, and 550*d* to prizes 504*a*, 504*b*, 504*c*, and 504*d* respectively is shown in FIG. 7.

For example, where the identifying characteristics 550 of the items 502 are barcodes, the matching apparatus 506 may be a barcode matching apparatus. The input device 510 may be a barcode scanner. A participant 200 may have the identifying characteristic (barcode) 550 associated with an item 502 that the participant 200 has collected read by the input device (barcode scanner) 510. The barcode scanner may read the barcode and relay that barcode to the processor 508. The processor 508 may be programmed to include an input lookup table. The input lookup table may list the barcodes from every item 502 dropped off into the adventurous area 300 and denote the prize 504 that corresponds to each barcode. The processor 508 may match the barcode to its corresponding prize 504 by using the input lookup table.

Prizes 504 corresponding to barcodes of the all the items 502 dropped off in the game 100 may be stored within the output device 512. The different prizes 504 may be stored in different slots or chambers within the output device 512. The processor 508 may be programmed to include an output lookup table. The output lookup table may list each prize 504 and the slot or chamber in the output device 512 within which this prize 504 is stored. After referring to the output lookup table, the processor 508 may send an electrical signal to the output device 512 to open only that slot or chamber within which the prize 504 associated with the deposited barcode is kept. Or, the processor 508 may cause the output device 512 to push the corresponding prize 504 into an accessible chamber within the output device 512. The participant 200 may then collect the prize 504 associated with the participant's item(s) from the output device 512. Alternatively, the output device 512 may simply indicate which prize 504 matches the particular item 502 or all of the items 502 a participant 200 has turned in. In some embodiments, prizes 504 may simply be based on the number of items 502 that respective participants 200 turn in, and additional or unclaimed prizes 504 may or may not be distributed to participants 200 (e.g., through a raffle). It may or may not be desirable for the participants 200 to know their prizes 504 until after the ending point.

The game 100 disclosed above may have a variety of themes, and the adventurous area 300, items 502, participants 200, sponsors 202 etc. may augment the theme. For example, the game 100 may have a theme revolving around motorcycles. The participants 200 may or may not be motorcycle-enthusiasts who drive around the adventurous area 300 in motorcycles for the duration of the game 100. In this embodiment, all or part of the adventurous area 300 may or may not emulate a motorcycle race track or a route that motorcycle-enthusiasts frequent, such as Route 66. The adventurous area 300 may have sharp curves, turns etc., and may have small hills or obstacles which the participants 200 have to clear on their motorcycles, however, the adventurous area 300 is not required to have these characteristics. The sponsors 202 in this embodiment may or may not represent different motorcycle manufacturers, or distributors or manufacturers of motorcycle accessories. The sponsors 202 could possibly have an assortment of equipment used in the motorcycle industry on display or for sale, such as glasses, clothes, helmets, tires, motorcycles etc. The sponsors 202 may, or may not, sell or otherwise provide fuel to the participants 200 driving motorcycles manufactured by the brand that the sponsors 202 are advertising. The items 502 dropped off into the adventurous area 300 may include checkered flags, plastic helmets or other objects that are typical to the motorcycle industry.

In another embodiment, the underlying theme may revolve around horses. In this embodiment, the participants 200 may or may not be horse-enthusiasts who ride on horses for the duration of the game 100. All or part of the adventurous area 300 may emulate a horse-racing track and may have small obstacles which the riders have to clear, or the adventurous area 300 may be, or resemble a ranch. It is understood, however, that the adventurous area 300 may not correspond to the theme in any respect, or may highlight the theme in ways other than those expressly noted. The sponsors 202 may or may not be clad with clothing that is generally popular amongst horse-enthusiasts, and may or may not market or otherwise provide equipment and gear that is used in the raising and racing of horses. The items 502 may, for example, be bags of hay, saddles, or other objects that are typically familiar to horse enthusiasts.

In another embodiment, the theme may be futuristic and the participants 200 may, for example, drive around the adventurous area 300 in newer model sports cars. The items 502 in this theme may or may not include magnets that stick to the sports cars when the sports cars drive by the items 502. Similarly, the game 100 may incorporate other themes such as a bicycle theme or a renaissance theme etc., and the participants 200 may travel around the adventurous area 300 in different ways, including on foot.

The game 100 disclosed above may be financed in a number of ways by organizers. For example, the organizers may or may not charge the participants 200 an entry fee, or the organizers may charge the entry fee to only a subset of the participants 200. The organizers may also, for example, charge different participants 200 a different entry fee. Also, the organizers may or may not charge the sponsors 202 a sponsoring fee to advertise the products. The organizers may possibly use part of these entry or sponsoring fees to pay for the prizes 504 that the participants receive at the end of the game 100, and the organizers may or may not retain the remaining portion of the fees as profit.

As an illustration, the game 100 may have five-hundred participants that register and pay fees at the time of the game 100 or in advance (e.g., though the Internet). The organizers may charge each participant $500 to participate in the game 100, thereby generating $250,000 in entry fees. Twenty-five sponsors may choose to sponsor their products in the game. The organizers may charge each sponsor 202 a sponsoring fee of $10,000, generating $250,000 in sponsoring fees. The items 502, for example, may yield prizes 504 to participants that are worth $300,000. Thus, in this case, the organizers would be left with $200,000 as profit, minus the cost to advertise and conduct the game 100. The prizes 504 may be determined after the gross income is known to ensure that the organizers do not incur a substantial loss.

The game 100 could or could not be televised live or as a recording, and may or may not be transmitted as pay-per-view. Different games 100 with varying themes could be held in the same or different adventurous areas 300, and though not required, these different games 100 could be compiled into a DVD series. The DVD series could then possibly be sold or rented, thereby generating an additional stream of revenue for the organizers.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A method of organizing and conducting a game, the method comprising the steps of:

a) arranging a plurality of contestants within a predefined adventurous area;

b) providing a plurality of items, each item having a distinct machine readable identifying characteristic;

c) providing an ultralight with a programmable ejection system comprising a global positioning device; the ejection system of the ultralight launching the plurality of items through the air into the adventurous area at random intervals while the ultralight is in flight and after the game has begun; programming of the ejection system being configured to: (1) ascertain the random intervals; and (2) ensure that no more than one of the plurality of items is launched at any particular location within the adventurous area by the ultralight;

d) allowing the contestants to search for and collect the items within the adventurous area until an end of the game; and e) providing a matching apparatus comprising a processor, a scanner, and an output device; the scanner being used to read the machine readable identifying characteristic of each item; the matching apparatus automatically dispensing for the contestant via the output device a prize correlating to the identifying characteristic of the item collected by the contestant.

2. The method of claim 1, wherein:

the game is based on a theme; and appearance of the items corresponds to the theme.

3. The method of claim 2, wherein the theme is selected from the group consisting of a futuristic theme, a horse enthusiast theme, a car enthusiast theme, and a motorcycle enthusiastic theme.

4. The method of claim 3, wherein:

a duration of the game is defined by a starting point and an ending point; and sponsors are arranged within the adventurous area for at least a part of the duration.

5. The method of claim 2, wherein the contestants are equipped with global positioning systems that display the location of each contestant.

6. The method of claim 5, wherein the global positioning systems further display the location of each item that is launched into the adventurous area.

7. The method of claim 1, wherein:

the items are biodegradable; and the game is videotaped for the purpose of being televised.

8. A method of conducting a game using a plurality of items, each item having distinct machine readable indicia, the method comprising the steps of:

a) arranging a plurality of contestants within a predefined adventurous area;

b) providing an ultralight with a programmable ejection system comprising a global positioning device; the ejection system of the ultraligh launching the plurality of items through the air into the adventurous area at random intervals while the ultralight is in flight and after the game has begun; programming of the ejection system being configured to: (1) ascertain the random intervals; and (2) ensure that no more than one of the plurality of items is launched at any particular location within the adventurous area by the ultralight;

c) allowing the contestants to search for and retrieve the items from the adventurous area until the end of the game;

d) correlating the machine readable indicia of each item to a corresponding prize; and f) allowing each contestant to retain the prize correlating to the machine readable indicia of the item collected by the contestant.

9. The method of claim 8, wherein:

the machine readable indicia comprises a bar code; and a correlating unit having a bar code scanner correlates the machine readable indicia of each item to a corresponding prize.

10. The method of claim 8, wherein the correlating unit comprises:

an input device having an opening for placement of the item being correlated to a prize; and an automated dispenser that dispenses the prize corresponding to the machine readable indicia of the item.

11. The method of claim 8, wherein:

a duration of the game is defined by a starting point and an ending point; and sponsors are arranged within the adventurous area for at least a part of the duration.

12. The method of claim 11, wherein the contestants are allowed to:

trade the items collected by the contestants with different items collected by other contestants; and trade the items collected by the contestants with products offered by the sponsors.

13. The method of claim 8, wherein:

the game is based on a theme; and appearance of the items corresponds to the theme.

14. The method of claim 13, wherein the theme is selected from the group consisting of a futuristic theme, a horse enthusiast theme, a car enthusiast theme, and a motorcycle enthusiastic theme.

15. The method of claim 13, wherein the theme is a futuristic theme.

16. The method of claim 13, wherein the items are biodegradable.

17. The method of claim 16 wherein the game is videotaped for the purpose of being televised.

* * * * *